US006000781A

United States Patent [19]

Akiyama et al.

[11] Patent Number: 6,000,781

[45] Date of Patent: Dec. 14, 1999

[54] SHUTTLE TYPE RECORDING APPARATUS

[75] Inventors: Yuji Akiyama, Yokohama, Japan; Shinji Kanemitsu, Irvine, Calif.; Hiromitsu Hirabayashi, Irvine, Calif.; Makoto Takemura, Irvine, Calif.; Miyuki Fujita, Tokyo, Japan; Akitoshi Yamada, Irvine, Calif.

[73] Assignee: Canon Kabushiki Kaisha, Tokyo, Japan

[21] Appl. No.: 08/901,108

[22] Filed: Jul. 28, 1997

[30] Foreign Application Priority Data

Jul. 30, 1996 [JP] Japan ..... 8-200835

[51] Int. Cl.[6] ..... B41J 2/015; B41J 3/54

[52] U.S. Cl. ..... 347/40; 347/37; 347/43

[58] Field of Search ..... 347/40, 41, 42, 347/43, 37; 400/37, 323, 82

[56] References Cited

U.S. PATENT DOCUMENTS

| | | | |
|---|---|---|---|
| 4,272,771 | 6/1981 | Furukawa | 347/12 |
| 4,576,490 | 3/1986 | Isobe | 400/82 |
| 4,692,778 | 9/1987 | Yoshimura et al. | 346/145 |
| 4,959,660 | 9/1990 | Suzuki et al. | 347/34 |
| 4,962,390 | 10/1990 | Yoshimura et al. | 347/42 |
| 5,594,475 | 1/1997 | Komakine et al. | 347/40 |
| 5,683,188 | 11/1997 | Miyazaki et al. | 347/41 |
| 5,749,662 | 5/1998 | Shibasaki et al. | 400/82 |
| 5,788,385 | 8/1998 | Inoue et al. | 347/37 |

FOREIGN PATENT DOCUMENTS 50-81437 7/1975 Japan .

*Primary Examiner*—N. Le
*Assistant Examiner*—Lamson D. Nguyen
*Attorney, Agent, or Firm*—Fitzpatrick, Cella, Harper & Scinto

[57] ABSTRACT

In a recording apparatus for recording on a recording medium by a plurality of recording heads, a scan unit has a carriage capable of mounting the recording heads at a predetermined interval and causes the recording heads to scan corresponding divided recording areas. A record control unit causes the recording heads to conduct a first record mode to record an area of a first recording width in a direction of scan by shared recording by the recording heads of the corresponding recording areas and a second record mode to record an area of a second recording width smaller than the recording width of the first recording width by causing at least one of the recording heads to record in the corresponding divided recording area when the corresponding divided recording areas are scanned. A distance between two recording apparatus mounted at outermost positions in the arrangement of the recording heads on the carriage is not larger than a difference between the first recording width and the second recording width.

25 Claims, 15 Drawing Sheets

SHUTTLE TYPE RECORDING APPARATUS

BACKGROUND OF THE INVENTION

1. Field of the Invention

The present invention relates to a serial type recording apparatus for recording characters and images on a recording medium while scanning a recording head against the recording medium. More particularly, the present invention relates to a shuttle type recording apparatus in which a plurality of recording heads arranged at a predetermined interval can record divided recording areas for the respective recording heads.

The present invention is particularly suitable for a recording apparatus for recording by applying coloring agent on the recording medium in accordance with image data, and it is more particularly suitable for an ink jet type recording apparatus in which liquid recording ink is discharged as the coloring agent to make a record.

The present invention is applicable to any equipment which uses the recording medium such a s paper, cloth, skin, unwoven cloth or OHP sheet and further metal or the like. Specific application equipments include office products such as a printer, a copying machine and a facsimile machine and industrial manufacturing machines.

2. Related Background Art

The serial type recording apparatus in which recording is made while scanning the recording head, has been commonly used in various recording apparatus because it is less expensive than a recording apparatus in which recording is made by using a full line head which covers an entire width of the recording medium such as recording sheet or the like.

In the serial type recording apparatus, a material which reacts to a heat generation element of a thermal head to a dedicated thermal sheet and a material which cause a dedicated photo-sensitive sheet to optically generate a recording color have been known as the material to generate color of the coloring agent to the recording material. As a system to make a record by applying the coloring agent to the recording material by the recording head, various systems have been put into practice and proposed. For example, an impact recording system in which an ink ribbon having liquid ink impregnated as the coloring agent is pressed and abutted against the recording medium by a print wire to transfer the ink, a thermal fusion transfer recording system or a thermal sublimation system in which a heat generating element of a thermal head is reacted to an ink ribbon head having a solid coloring agent applied to transfer the ink and an ink jet system in which liquid recording ink is discharged to make a record.

Recently, from a stand point of plain sheet recording, the latter recording system for applying the coloring agent is main stream. Among them, the ink jet recording system has advantages of low noise, low running cost, easiness to make the apparatus compact, ability of plain sheet recording and easiness for color recording, and has been commonly used in the recording apparatus such as a printer and a copying machine.

In the serial type recording apparatus, recording heads each of which allows the recording only in a relatively small limited area of the recording element such as a discharge port provided in the recording head are arranged on a carriage and they are sequentially scanned to make a record. Thus, it is relatively difficult to increase a recording speed and the increase of the recording speed has been a problem for the serial type.

On the other hand, in order to increase the speed of the image recording, it has been proposed and put into practice to increase a recording width (arrangement range of recording elements) of the recording head, to increase the carriage speed and a recording frequency to reduce a scan time for to scan bilaterally to make a record. However, each system has limitation. For example, in order to increase the recording width, corresponding improvement of precision in manufacturing the head is required and the recording head becomes expensive and a capacity of print buffer for temporarily storing the record data increases so that a problem is raised in terms of cost. In the system in which the color is generated by utilizing heat or the coloring agent is applied, means for preventing the deterioration of the recording quality or the break of the head due to self-temperature-rise of the recording head is needed particularly when the recording width is large. In the ink jet recording system in which the liquid recording ink which is not in contact with the recording medium, when a recording head of a large recording width, means to prevent the deterioration of the recording quality due to cockling of the recording medium by absorption of moisture of the ink is complex. When the recording frequency is raised, it is necessary to increase the scan speed of the carriage to maintain a certain pixel density, but in this case, a load of a drive source increases and the recording quality may be deteriorated by vibration of the ink in the recording head due to the high speed of the carriage.

A system which is relatively effective to increase the speed of the serial type image recording apparatus is disclosed in JP-A-50-81437 and U.S. Pat. No. 4,272,771. This reference discloses that, in order to concurrently print on a left half and a right half of a print line, a left print head assembly and a right print head assembly supported by one carriage mechanism are used to attain the speed-up of approximately two times. It also teaches that a higher recording speed may be attained by increasing the number of print head assemblies to more than two or conducting the bilateral printing.

However, the prior art disclosed in the reference, in most cases, divides the recording areas merely from a stand point of high speed of recording. When a plurality of recording heads share the divided recording areas for recording, high speed recording may be attained for a sheet of a relatively large size as well as for a sheet of a relatively small size, but even in such a case, it is desirable to make the apparatus compact by effectively utilizing a scan space of the carriage on which a plurality of recording heads are arranged.

No prior art technique positively considers the overlapping recording areas scanned by a plurality of heads in an overlapped manner. The prior art technique teaches that the overlapping record scan areas are to be eliminated as much as possible from a viewpoint of the high speed recording.

SUMMARY OF THE INVENTION

It is an object of the present invention to provide a recording apparatus having a plurality of heads mounted thereon which can produce record images of various sizes without increasing the size of the apparatus.

It is another object of the present invention to provide a recording apparatus which can produce a record image of a large size as well as a high grade record image with a small size.

In order to achieve the above objects, in accordance with an aspect of the present invention, there is provided a recording apparatus for recording on a recording medium by using a plurality of recording heads comprising scan means having a carriage capable of mounting the recording heads at a predetermined interval for causing the recording heads to scan corresponding divided recording areas; and record control means for causing the recording heads to conduct a first record mode to record an area of a first recording width in a direction of scan by shared recording by the recording heads of the corresponding recording areas and a second record mode to record an area of a second recording width smaller than the recording width of the first recording width by causing at least one of the recording heads to record in the corresponding divided recording area when the corresponding divided recording areas are scanned, wherein a distance between two recording apparatus mounted at outermost positions in the arrangement of the recording heads on the carriage is not larger than a difference between the fist recording width and the second recording width.

In accordance with another aspect of the present invention there is provided a recording apparatus for recording on a recording medium comprising scan means having a carriage capable of mounting a plurality of first recording heads arranged at a predetermined interval and at lease one second recording head arranged between the first recording heads for causing the first recording heads to scan corresponding divided recording areas, the second recording head having a different characteristic from those of the first recording heads and the divided recording areas having entire recording area of the recording medium divided in a direction of scan and record control means for causing the first recording heads to conduct a first record mode to recording areas of a first recording width in the direction of scan by shared recording by the first recording heads of the corresponding divided recording areas, a second mode to record an area of a second recording width smaller than the first recording width by single one of the first recording heads or by the cooperation of at least two of the recording heads and the second recording head and a third record mode to record an area of a third recording width smaller than the recording width of the second recording width by the cooperation of one of the first recording heads and the second recording head when the corresponding divided recording areas are scanned, wherein a first distance between two first recording heads mounted at the outermost positions in the arrangement of the first recording heads on the carriage is not larger than a difference between the first recording width and the second recording width, and a second distance between the first recording heads and the second recording head is not larger than one half of the difference between the first recording width and the second recording width.

DESCRIPTION OF THE PREFERRED EMBODIMENTS

The embodiments of the present invention are now explained with reference to the drawings.

Figure 1:
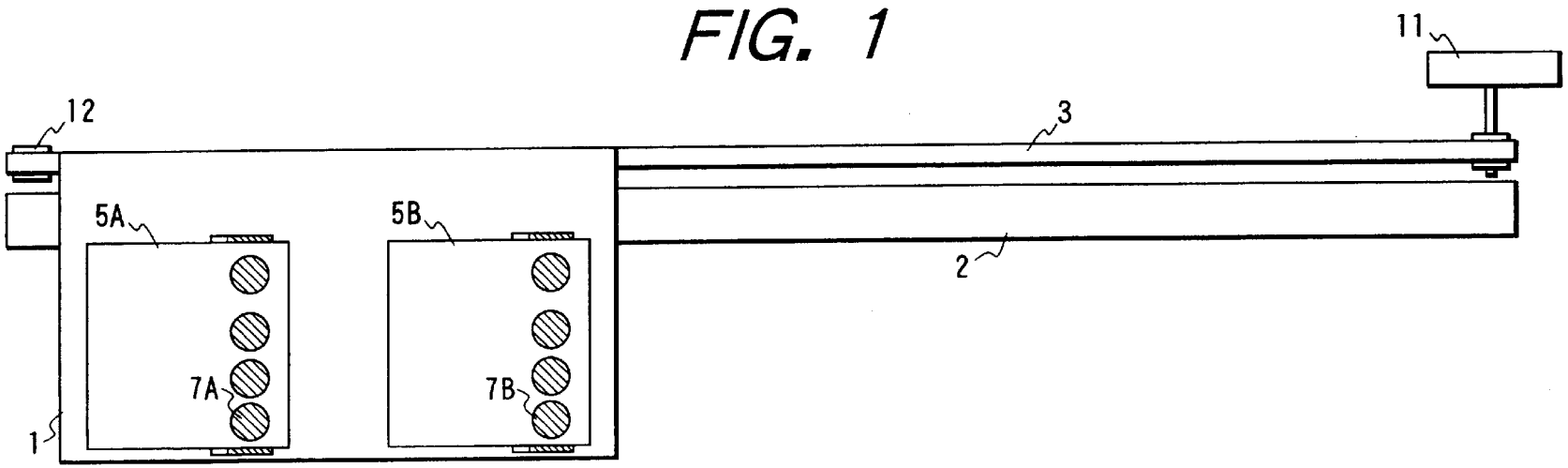
FIG. 1 shows a schematic top view of a recording apparatus to which the present invention may be applied.
Figure 2:
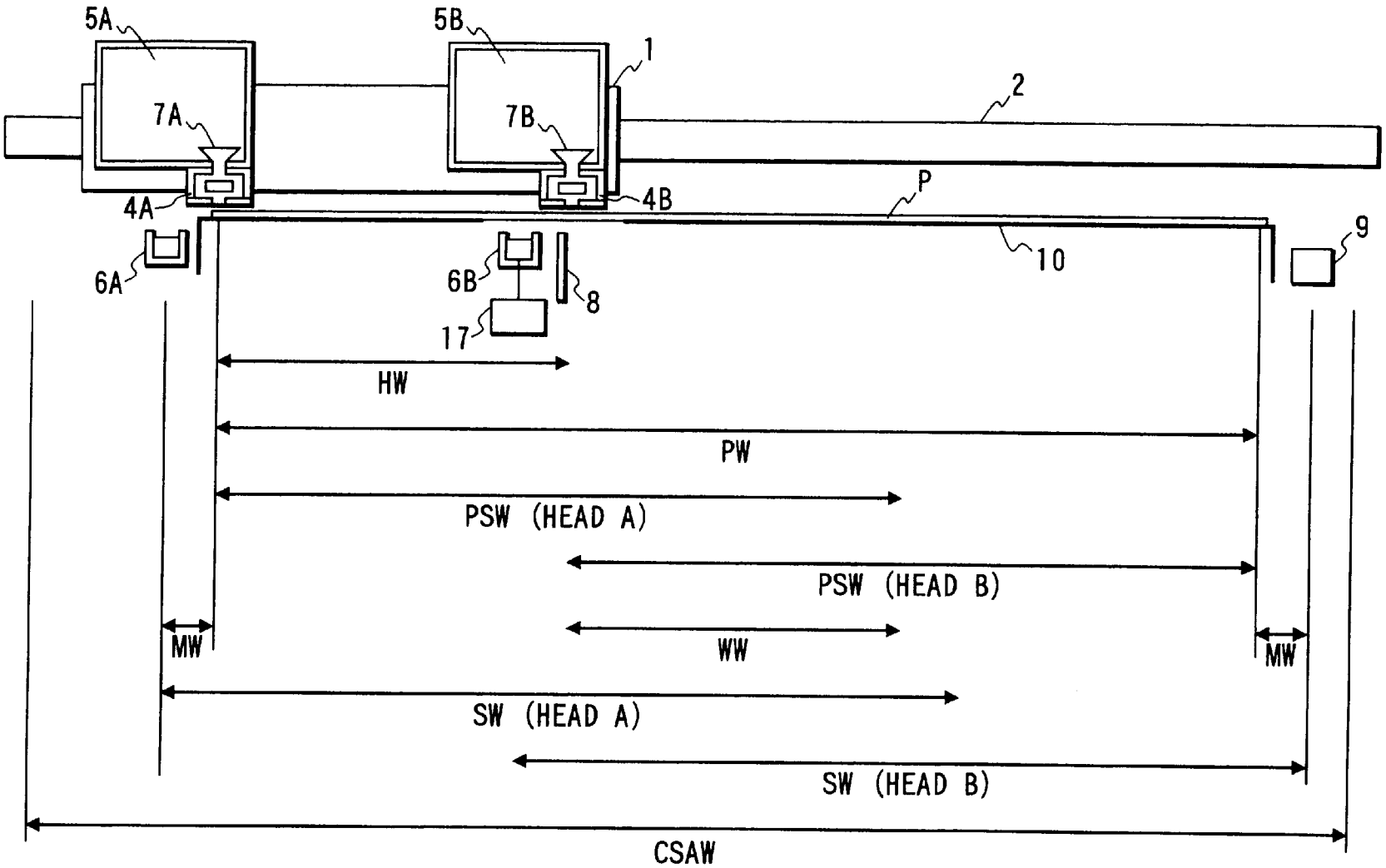
FIG. 2 shows a schematic sectional view of the recording apparatus.

FIGS. 1 and 2 show schematic top view and schematic sectional view of the recording unit in an ink jet recording apparatus to which the present invention may be applied.

A recording medium P inserted to a sheet feed position (not shown) of the recording apparatus is fed to a recordable area of a recording head unit by a feed roller, not shown. A platen 10 is provided under the recording medium in the recordable area. A carriage 1 is bilaterally movable by a guide shaft 2. As a result, each of heads 4A and 4B on the carriage can reciprocally scan the divided recording areas assigned thereto. The recording heads 4A and 4B for discharging inks are mounted on both sides of the carriage 1 and ink tanks 5A and SB for supplying the inks to the respective recording heads 4A and 4B are mounted on the carriage 1. Thus, each of the recording heads 4A and 4B makes a record by discharging the inks in accordance with record data while it scans the corresponding area.

A recovery unit (caps 6A and 6B) is provided below the platen 10 on a left side and at a center of the area through which the carriage 1 may be moved, and it is used to cap the discharge ports of the recording heads 4A and 4B during non-record mode. Numerals 7A and 7B denote ink supply ports for introducing the inks into the recording heads 4A and 4B.

The configuration of the present invention provides a large effect even for monochromatic recording such as black and white. In the present embodiment, the color recording by using a plurality of inks is explained.

The recording heads 4A and 4B having a group of discharge ports for each of ink colors such as black (Bk), cyan (C), magenta (M) and yellow (Y) integrally formed, and the tanks 5A and 5B having ink tanks for storing the Bk, C, M and Y inks for supplying the inks to the recording heads 4A and 4B integrally formed are removably mounted on the both sides of the carriage 1.

The 64 Bk discharge ports and 24 C, M and Y discharge ports, respectively, are integrally formed substantially transversely to a scan direction at a density of 360 dpi, respectively, and the respective groups of discharge ports are spaced by eight discharge port pitches. The two recording heads 4A and 4B are aligned to each other and mounted on the carriage 1.

In FIG. 2, as one of maintenance unit of the recording heads 4A and 4B, two caps 6A and 6B are provided on the left side and at the center of the apparatus at the interval corresponding to the recording heads 4A and 4B. Each of the caps 6A and 6B is vertically movable. When the recording medium P is not present at the recording unit and the recording head is located at the cap position during the non-print mode, the caps 6A and 6B join with the recording heads 4A and 4B to cap them to prevent the increase of the viscosity due to the evaporation of the inks in the discharge ports of the recording heads 4A and 4B and the failure of discharge due to the solidification. The cap 6B near the center is linked to a pump unit 17. The pump unit 17 is used to create a negative pressure in a suction recovery process to suck the ink from the discharge port of the recording head 4A or 4B while the cap 6B is joined with the recording head 4A or 4B.

The pump unit 17 may be of any construction such as known cylinder pump or tube pump. Since the cap has functions of forced recovery of the ink as well as the prevention of evaporation, it is of quasi-atmosphere open structure to link the cap to atmosphere by a porous structure in order to fully suppress the evaporation of the ink and avoid a pressure variation in the cap due to a temperature change. The pump unit may be provided in both caps 6A and 6B. In the present embodiment, in order to simplify the construction, the pump unit 17 is connected to only the cap 6B near the center as described above. In the suck recovering process for the left side recording head 4A, the carriage 1 is moved so that the cap 6B near the center may be used. Disposed liquid by the suction is sent to a disposed liquid tank (not shown).

The left side cap 6A also functions as a preliminary discharge receptacle to be described later. Like the cap 6B, the cap 6A is of quasi-atmosphere open structure to link the cap to atmosphere by the porous structure such as the tube in order to fully suppress the evaporation of the ink and avoid the pressure variation in the cap due to the temperature change.

As the maintenance unit of the recording heads 4A and 4B, a blade 8 for wiping the discharge ports of the recording heads 4A and 4B are further provided. The blade 8 is formed by an elastic material such as rubber in order to wipe the ink and the treatment liquid attached to the discharge port forming planes of the recording heads 4A and 4B. The blade 8 is used in common by the two recording heads 4A and 4B and is vertically movable by an elevator unit, not shown, so that it may assume an up position to wipe the surface of the recording head and a down position at which it does not interfere the surface of the recording head. Two blades 8 may be provided for the two recording heads 4A and 4B. In the present embodiment, in order to simplify the construction, only one blade is provided near the center so that it acts to the two recording heads 4A and 4B in common.

As the maintenance unit of the recording heads 4A and 4B, the preliminary discharge receptacle 9 is further provided on the opposite side to the home position (cap position). The cap 6A and the preliminary discharge receptacle 9 are used to discharge the ink at a predetermined timing separately from the recording in order to prevent the change of the discharge characteristic and the change of the color tone due to the evaporation of the ink in the nozzle which has not been used for a long time during the record mode or the record stand-by mode. Since it may be required even in the record mode, it must be provided in an area through which the recording medium P does not pass.

The ink jet recording head of the present embodiment adopts a recording system in which heat generating elements which are electro-thermal transducers are arranged for the respective ink discharge ports and drive signals corresponding to the record information are applied to the heat generating elements to discharge the inks from the discharge ports.

Figure 3:
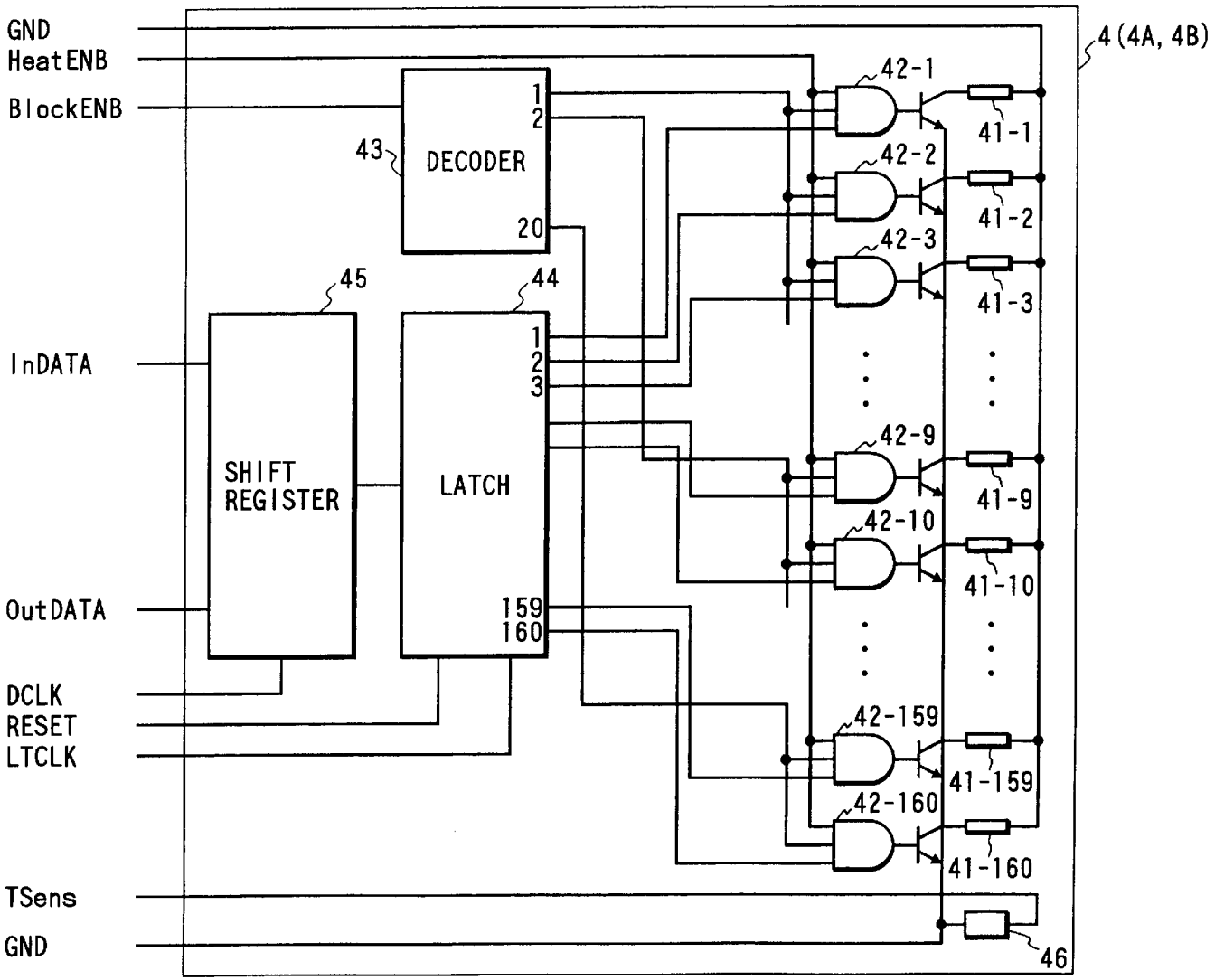
FIG. 3 shows a block diagram of a drive unit of a recording head used in the recording apparatus.

FIG. 3 shows a block diagram of a configuration for the drive of the heat generation elements of the recording head 4.

The heat generating elements 41-1 to 41-160 generate heats independently from each other. Since a large current must be flown at a time if all of those heat generating elements 41 are concurrently driven, a load of a power supply increases. Further, since an energy supplied to individual heat generating elements is reduced by a voltage drop across a wiring resistor, normal recording may not be attained. Thus, the problem in the image quality is a concern. Thus, in the present embodiment, the discharge ports are divided into 20 blocks with one block comprising eight discharge ports including eight discharge ports of color separation, and the drive timing for each block is adjusted by a signal from a decoder 43 to make a record as is done in the known time division drive. The recording head 4 is tilted by an amount corresponding to the scan speed of the recording head 4 so that the linearly of the record is not lost by the time division drive.

The ink in the ink liquid path which was quickly heated by the heat of the heat generating element 41 forms air bubbles by the film boiling. By the pressure of the air bubble generation, the ink droplets are discharged toward the recording medium P and characters or images are formed on the recording medium. The volume of the ink droplet of each color is approximately 40 ng. An ink liquid path linked to the discharge port is provided in each of the discharge ports. A common liquid chamber for supplying the inks to those liquid paths is provided for each color.

The ink is supplied from the common liquid chamber to the ink tank 5 through the ink supply path. The heat generating elements 41 which are electro-thermal transducers for generating a thermal energy used for discharging the ink droplets and electrode wiring for supplying a power thereto are provided in the ink liquid path for each discharge port. Those heat generating elements 41 and the electrode wiring are formed by a film forming technique on a substrate made of silicon. A protection film is formed on the heat generating elements 41 to prevent the ink from directly contacting to the heat generating elements 41. Further, a diaphragm made of resin or glass material is laminated on the substrate to form the discharge ports, the ink liquid paths and the common liquid path. In this manner, since the recording system which uses the heat generating elements 41 which are electro-thermal transducers uses the air bubbles formed by the application of the thermal energy when the ink droplets are discharged, it is usually called a bubble jet recording system.

AND gates 42-1 to 42-160 logically ANDs a selection signal for the time division which is outputted from the decoder 43 and the image data outputted from a latch circuit 44 and a heat enable signal which defines a drive time to output a drive signal to the heat generating elements 41. A shift register 45 converts the serially inputted image data to parallel data and outputs it to the latch circuit 44.

As a monitor unit for the recording heads 4A and 4B, a temperature sensor 46 is provided in the recording head 4A in the present embodiment. Thus, an optimum drive condition of the recording head in compliance to the temperature of the recording heads 4A and 4B is determined and the maintenance unit is operated in accordance with the temperature information to stabilize the recording characteristic.

Figure 4:
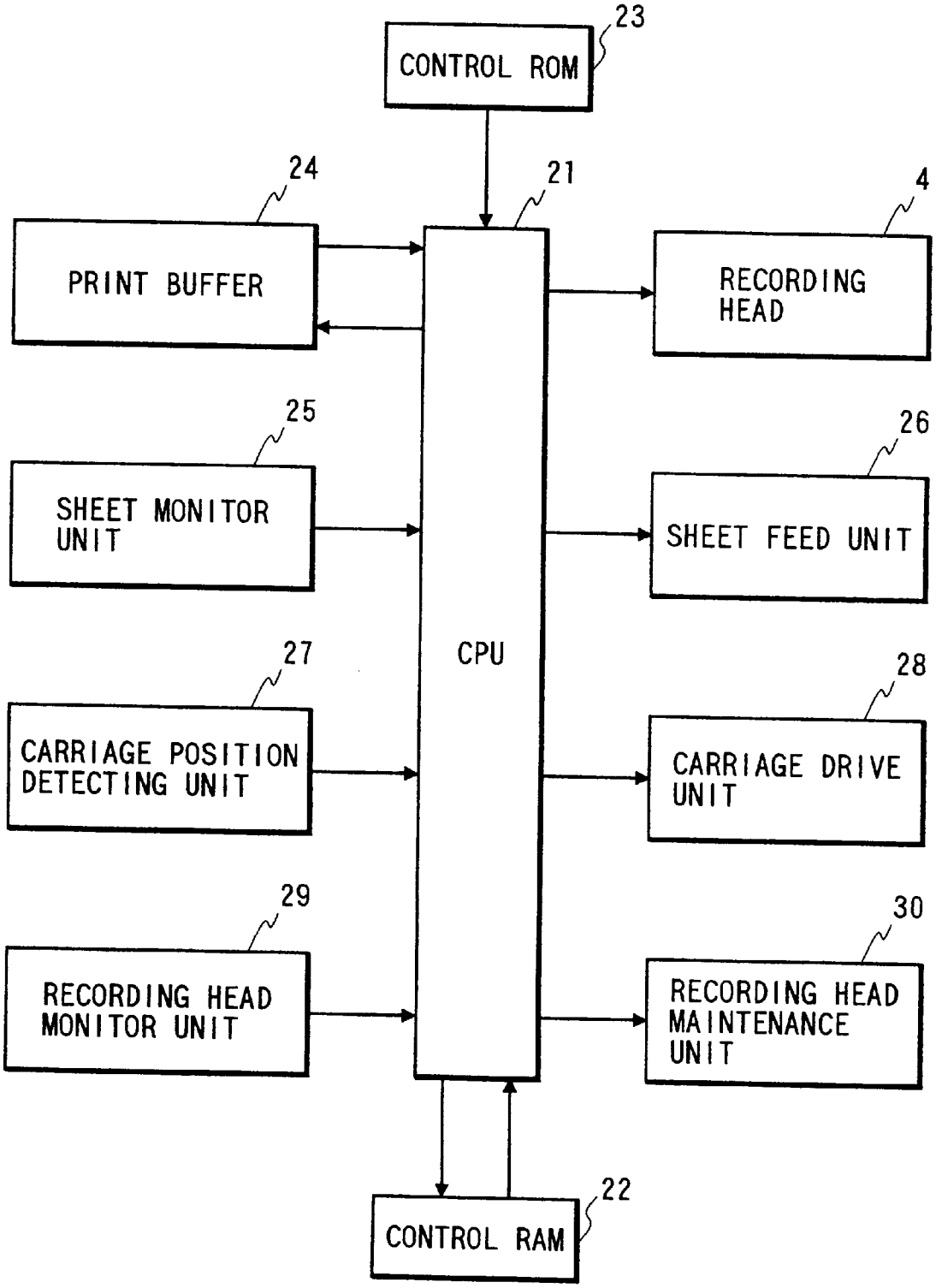
FIG. 4 shows a block diagram of a control unit of the recording apparatus.

FIG. 4 shows a block diagram of a control unit of the ink jet recording apparatus of the present embodiment. Data of the characters or the images to be recorded (hereinafter referred to as image data) is inputted from a host computer to a reception buffer of the recording apparatus. Data for checking if the data is correctly transferred and data for indicating an operation condition of the recording apparatus are transferred from the recording apparatus to the host computer. The data in the reception buffer is temporarily stored in a print buffer (RAM) 24 while it is controlled under the management of a CPU 21, a control RAM 22 and a control ROM 23, and it is supplied to the recording heads 4A and 4B as the record data. The sheet feed unit 26 controls a drive source such as a motor to drive a sheet feed roller and a line feed roller by a command from the CPU 21 in accordance with the information of a sheet monitor unit 25. A carriage drive unit 28 controls a carriage drive source by a command from the CPU 21 in accordance with the information of a carriage position detecting unit 27. A recording head maintenance unit 30 maintains the recording head 4 and optimizes the drive condition thereof by a command from the CPU 21 in accordance with the information from a recording head monitor unit 29 comprising sensors for detecting the temperature of the recording head and the presence or absence of the ink.

The carriage unit and the drive thereof in the present embodiment are now explained in more detail.

As shown in FIGS. 1 and 2, the carriage 1 is bilaterally movable along two guide shafts 2 (one of which is not shown) so that it can reciprocally scan the recording area. The carriage 1 is driven and scanned forwardly and backwardly in accordance with the rotational drive of the carriage motor which is the carriage drive source 11 through the drive belt 3.

In order to conduct the drive of the carriage drive more precisely, a linear encoder, not shown is used as a carriage position detecting unit. As the linear encoder, either optical type or magnetic type may be used.

Since the present embodiment adopts the time division drive system as described above, if the scan speed of the recording heads 4A and 4B and the discharge interval for each block deviate, the record position of the ink is shifted and the record quality is lowered. Accordingly, it is desirable that the carriage feed speed is stable.

Referring to FIG. 2, the operations and the positional relationship of the carriage 1, the carriage drive unit 28, the recording heads 4A and 4B and the recording head maintenance unit 30 are explained in detail.

FIG. 2 shows the position of the carriage in the left end recording. The left side recording head 4A is positioned at the left end of the entire recording width PW and the right side recording head 4B is arranged on the carriage 1 with the head interval HW so that it is positioned at the left end of the overlapping recording width WW which is provided as required. That is, a relation of HW=(PW−WW)/2 is met. The head interval HW indicates a discharge port-to-discharge port distance of the recording heads 4A and 4B.

Figure 5:
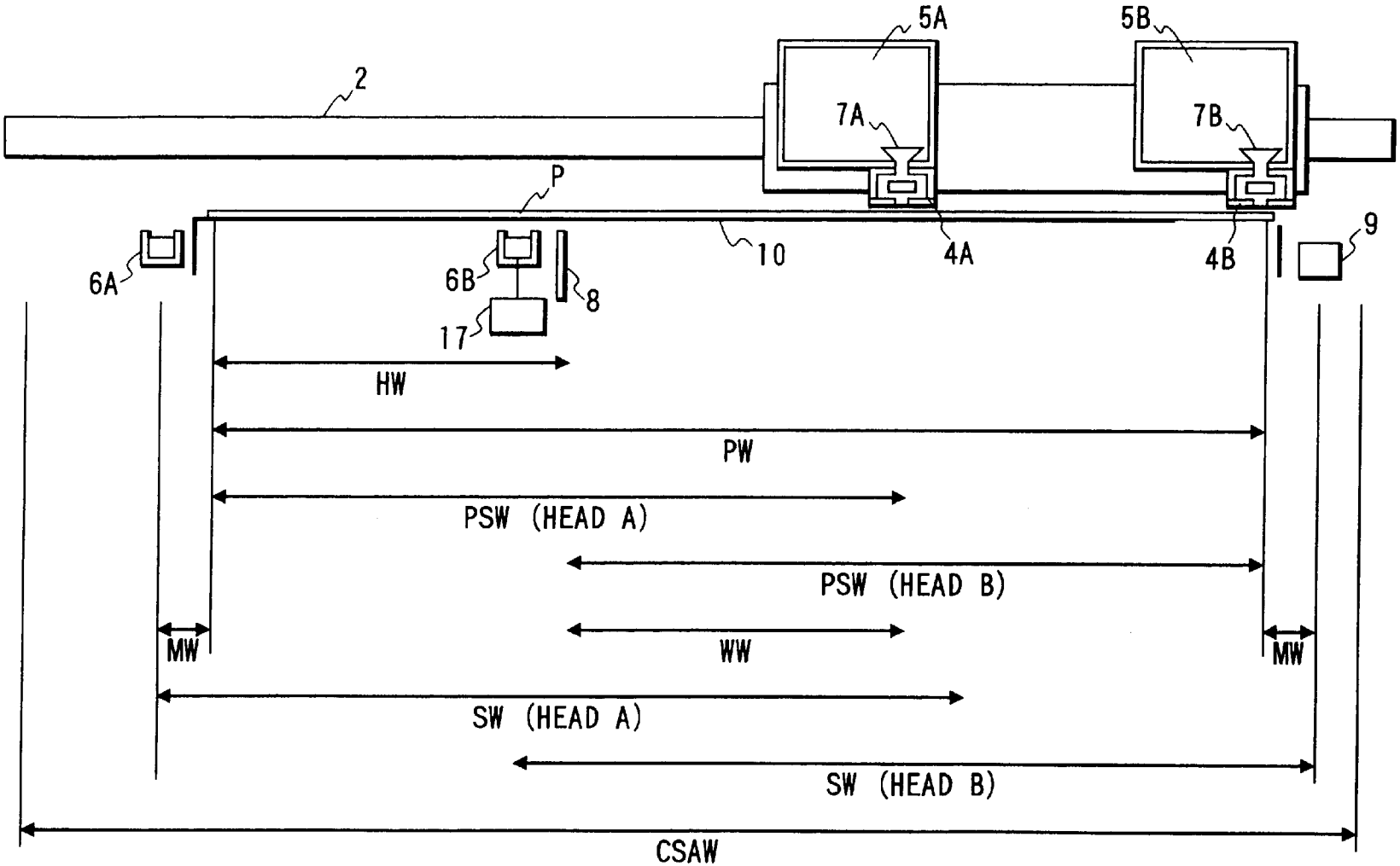
FIG. 5 illustrates right end recording in the recording apparatus.
Figure 6:
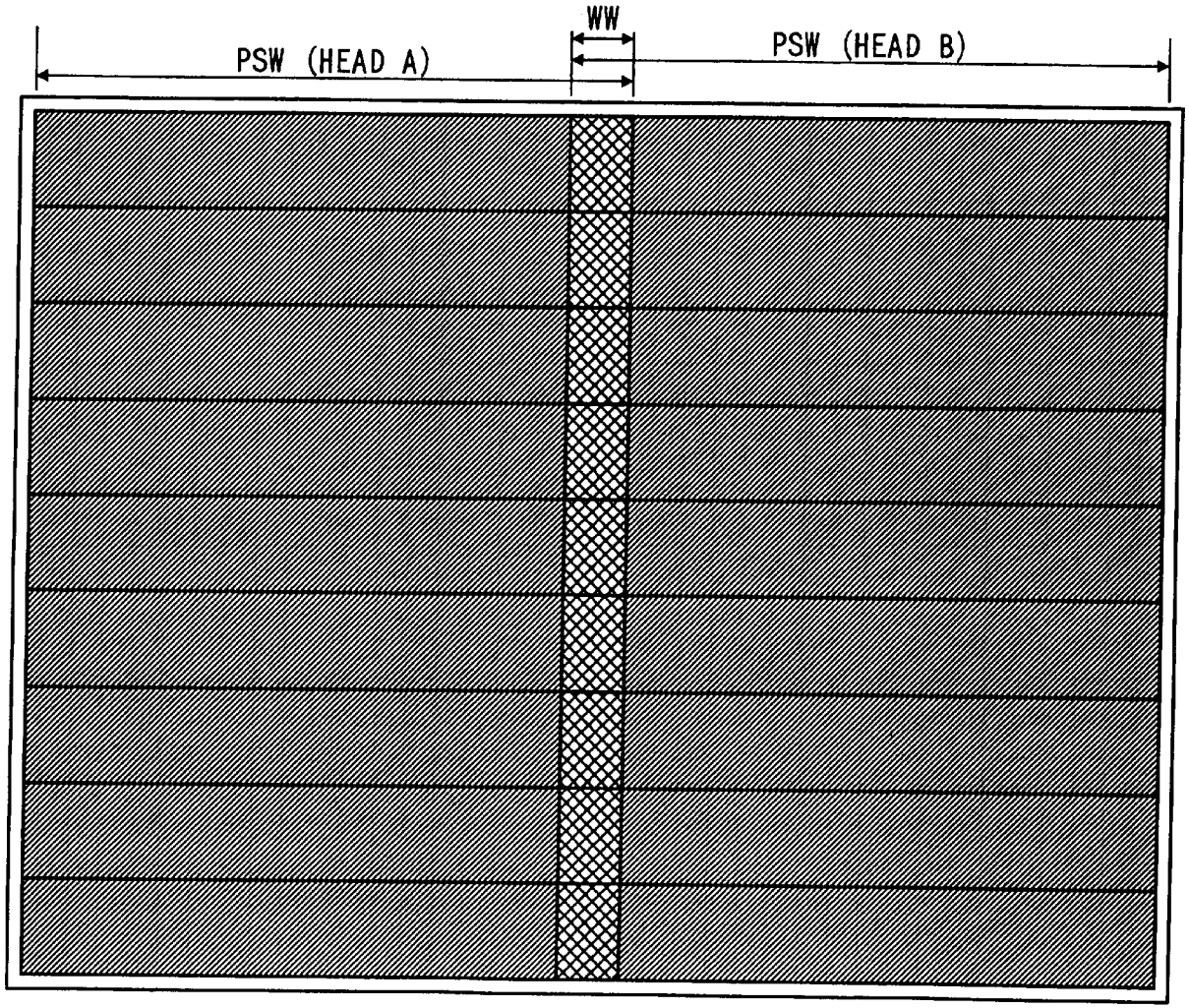
FIG. 6 illustrates sharing of recording areas in the recording apparatus in accordance with one embodiment of the present invention.

FIG. 5 shows the position of the carriage 1 in the right end recording as opposed to FIG. 2. The right side recording head 4B is positioned at the right end of the entire recording width PW and the recording head 4A is positioned on the right of the overlapping recording width. At this time, the carriage 1 is moved to the right by the PSW (the recording area of the recording head). Accordingly, as shown in FIG. 6, the recording head 4A records the left side PSW area of the entire recording width and the recording head 4B records the right side PSW of the entire recording width, and the center overlapping recording area WW is recorded by appropriate sharing of the two recording heads 4A and 4B.

As described above, in the present embodiment, the preliminary discharge receptacles 6A and 9 are provided on both sides as one of the maintenance units of the recording heads 4A and 4B. It may be required to drive the carriage even during recording in order to move the recording heads 4A and 4B to those positions. For the preliminary discharge of the recording head 4A, it is necessary to drive the carriage to the left additionally by the preliminary discharge width MW from the left end of the entire recording width, and for the preliminary discharge of the recording head 4B, it is necessary to drive the carriage to the right additionally by the preliminary discharge width MW from the right end of the entire recording width. The carriage scan width therefor is SW (the scan area of the recording head). For the scan drive of the carriage 1, an acceleration/deceleration width necessary for the rise and the fall is usually needed. The preliminary discharge may be conducted in the acceleration/deceleration area of the carriage. In the present embodiment, since the acceleration/deceleration width may be shorter than the preliminary discharge width MW, the actual carriage scan width SW need only consider the left and right preliminary discharge widths MW and it meets a relation of SW=(PW+WW)/2+MW×2.

A sum of distances from the discharge ports of the respective recording heads 4A and 4B to the carriage ends for the respective discharge ports is defined as ALT, and the width CSAW of the scan space of the carriage 1 is a sum of the carriage width and the carriage scan distance and it meets a relation of CSAW =PW+MW×2+ALT.

The acceleration/deceleration width or the preliminary discharge width MW of the carriage and the distance and the sum ALT of the distances from the discharge ports of the respective recording heads 4A and 4B to the carriage ends are necessary spaces to construct the apparatus. Namely, when the unit for the capping is provided in the recording area as it is while taking the compactness of the apparatus into account, the space for the ALT must be established. Accordingly, the factor to determine the size of the recording apparatus, particularly the widthwise size is the width excluding the above necessary space and it is important for the compactness of the apparatus that the above width substantially corresponds to the desired recording width PW. This means that the sum of the discharge port interval HW between the heads 4A and 4B and the recording area width PSW of the head corresponds to the recording width PW, that is, it meets a relation of HW=PW−PSW. For the compactness of the apparatus, it is preferable to meet at least HW <PW−PSW.

On the other hand, in order to attain the high speed recording, the head interval HW is an important factor. An optimum head interval HW under the size constriction of the apparatus described above is now explained.

Figure 7:
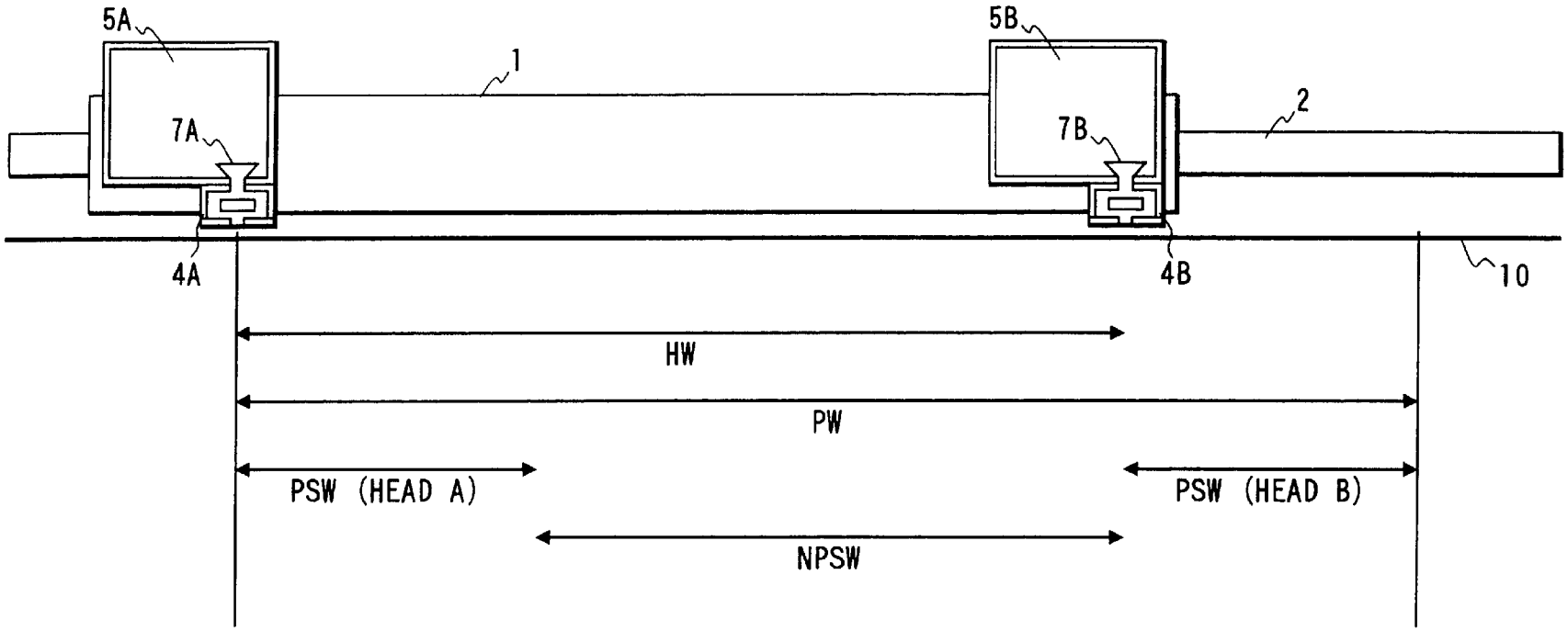
FIG. 7 illustrates a case in which a recording head interval is larger than one half of a recording width in the recording apparatus.

FIG. 7 shows a construction when the head interval HW is larger than one half of the recording width PW.

In this case, as seen from FIG. 7, when the movement of the carriage is set such that the positions of the discharge ports of the recording heads 4A and 4B are within the recording width PW which is the size constriction of the apparatus, the recording can be made by the recording heads 4A and 4B only in the area PSW and a non-record area NPSW is created. Accordingly, unless the constrictive recording width PW is increased to expand the scan length, it is not possible to make the record without the non-record area.

Figure 8:
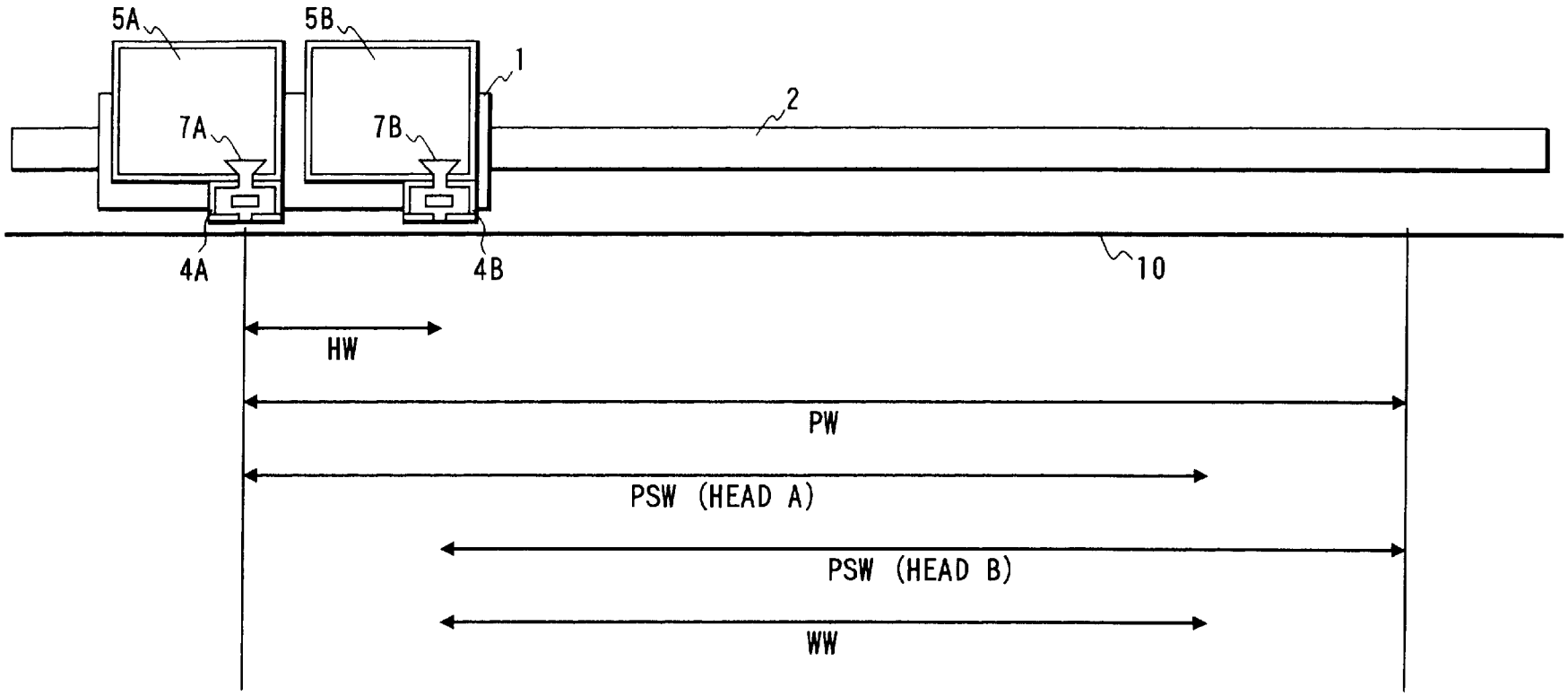
FIG. 8 illustrates a case in which the recording head interval is smaller than one half of the recording width in the recording apparatus.

FIG. 8 shows a construction when the head interval HW is smaller than one half of the recording width HW.

In this case, when the movement of the carriage is set such that the positions of the discharge ports of the respective recording heads 4A and 4B are within the recording width PW, the recording heads 4A and 4B can male records in the PSW area, respectively. The center overlapping recording area WW is recorded by appropriate sharing by the two heads 4A and 4B to make the record of the desired recording width PW.

However, when the overlapping recording area WW is relatively large, the scan length of the carriage increases, which leads to the low recording speed.

Figure 9:
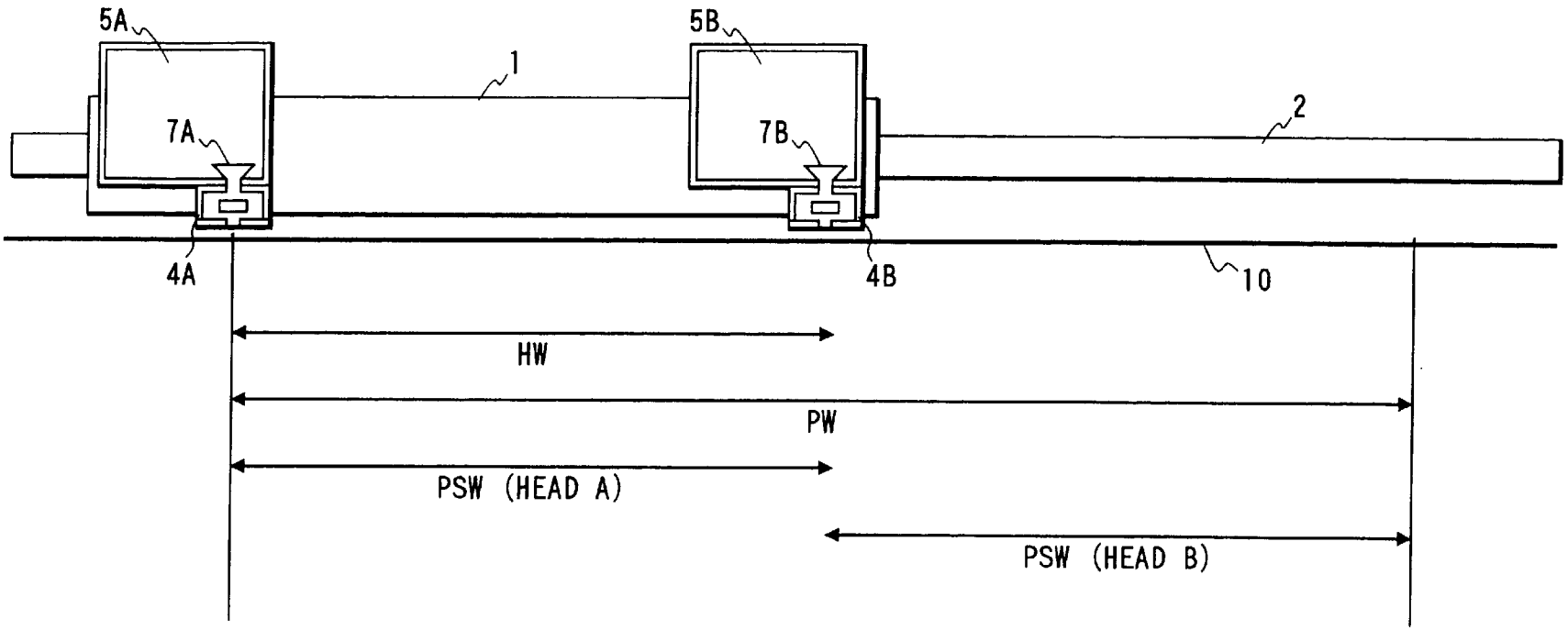
FIG. 9 illustrates a case in which the recording head interval is one half of the recording width.

FIG. 9 shows a construction when the head interval HW is one half of the recording width PW. In this case, when the movement of the carriage is set such that the positions of the discharge ports of the recording heads 4A and 4B, respectively, are within the constrictive recording width PW, the recording heads 4A and 4B can make records in the respective PSW areas, but the overlapping recording width WW shown in FIG. 8 is not present.

Of the three constructions shown in FIGS. 7, 8 and 9, the construction of FIG. 9 can attain the recording at a highest speed.

When different recording heads 4A and 4B are used, it is preferable that the overlapping recording area WW is present in order to make a smooth record without joining stripes or abrupt change of density at the switching point of the heads. In this overlapping recording area, versatile recording may be made by using a plurality of heads of different sizes and different characteristics.

Accordingly, for an effective head interval HW, it is preferable to meet the following relation:

$$HW<PW/2 \text{ and}$$

HW is as large as possible within the range of the above formula.

Referring to FIGS. 10 to 14, several constructions which meet the conditions of the compactness of the apparatus and the high speed recording are explained.

Apparatus Embodiment 1

Figure 10:
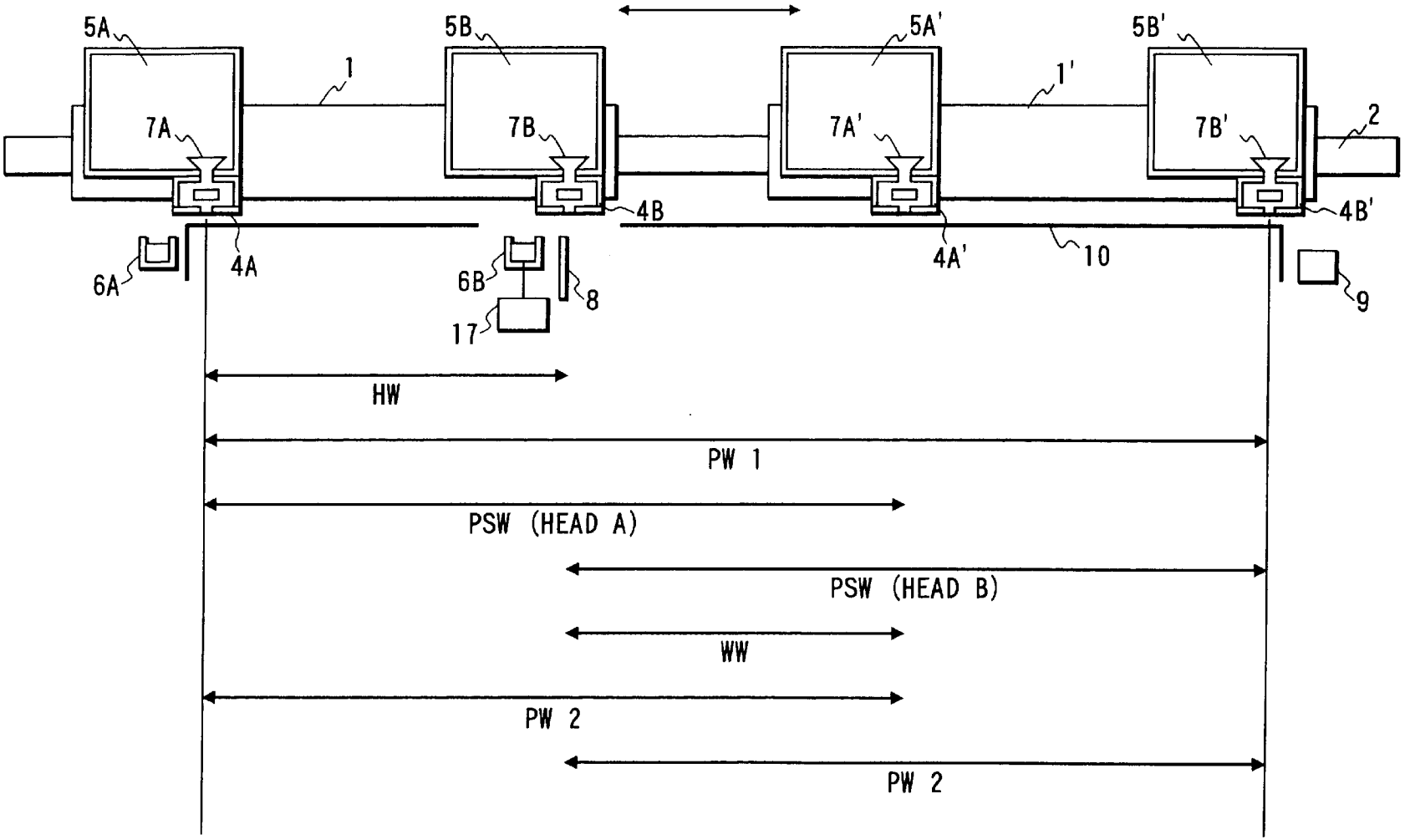
FIG. 10 schematically shows the recording apparatus in accordance with a configuration 1 of the present invention.

FIG. 10 shows a schematic construction of an apparatus capable of recording on sheets of at least two sizes.

The carriage 1, the recording heads 4A and 4B, the ink tanks 5A and 5B and the ink supply ports 7A and 7B are shown at their positions in the left end recording, and the carriage 1', the recording heads 4A' and 4B', the ink tanks 5A' and 5B'and the ink supply ports 7A' and 7B' are shown at their positions in the right end recording.

The first recording width PW1 shows a maximum recordable width and PW2 shows a second recording width. In the present embodiment, the width PW2 shows an example which is recordable by one recording head.

In this case, when PW2 is set in accordance with a sheet size which is frequently used, it is not necessary to always provide two recording heads and two recording heads may be mounted only when a record is to be made to a size larger the PW2.

From FIG. 10, in order to record the width PW2 by one recording head, it is necessary that the head interval $HW \leqq PW1-PW2$.

When the head interval HW is set as described above, the recording width of PW2 (=PSW) from the left end can be recorded by using the recording head 4A and the recording width of PW2 (=PSW) from the right end can be recorded by using the recording head 4B. The recording width PW1 has the overlapping recording area WW and the recording may be made by using the recording heads 4A and 4B.

It is preferable that the recordable sheet widths PW1 and PW2 are determined based on easily available from form sizes.

The commonly used sheet sizes are A4 size (sheet width: 210 mm), A3 size (sheet width: 297 mm), B5 size (sheet size: 182 mm), B4 size (sheet size: 250 mm), Letter size (sheet size: 8.5") and Ledger size (sheet size: 11"). The A4 size and the Letter size are particularly used frequently.

The dimensions of the A-Series size such as the A3 size, the A4 size, and the B-Series size such as the B4 size, the B5 size are defined as the sheet working finish dimension of the Japanese Industrial Standard JIS P0139. The dimensions of the A-Series sizes are conformable to the international standard and the dimensions of the B-Series sizes are Japanese unique standard.

For the A-Series sizes, a sheet having an area of approximately 1 $M^2$ is a dimension reference size (A0 size 841 mm×1189 mm), and for the B-Series sizes, a sheet having an area of 1.5 $m^2$ is a dimension reference size (B0 size: 1030 mm×1456 mm). A ratio of a minor side to a major side is $1/\sqrt{2}$, respectively.

The sheet sizes smaller than the A0 size or the B0 size such as the A3 size, A4 size and B5 size are formed by repeating the half-size cutting of the A0 size or B0 size of the above dimensions.

The Letter size and the Ledger size are commonly used in the United States and they are forms different from the above series.

As described above, the PW2 has a high use frequency and it is preferable to set it to the sheets of high use frequency. Accordingly, it is preferable to set the PW2 to the width of the A4 size or the Letter size. By setting to those sizes, it is conformable to all sheets of smaller sizes.

A relationship of the ratio of PW1 and PW2 changes depending on a particular form of sheet selected as the maximum recordable width. In the prior art recording apparatus, a short area width of approximately 3 mm from each of the left and right sides of the recording sheet width is recordable area and it is difficult to record an image without a margin which is a non-record area. It is desirable that the margin which is the non-record area is as small as possible. Recently, a recording apparatus which allows an image of a desired form size even if a recording sheet of a larger size than a desired form size has been demanded. It has a high demand particularly in the industries of design and printing for proofing purpose. In the present embodiment, by taking this into account, the recordable width is determined based on the size of the form size sheet.

Common combinations are assumed in the following description.

When PW2 is set to the sheet width 210 mm of the A4 size, in order to allow PW1 to record up to the sheet width 250 mm of the B4 size, it is necessary to meet a relation of:

$$PW1 \geqq 1.190 \times PW2$$

When PW2 is set to the sheet width 210 mm of the A4 size, in order to allow PW1 to record up to the sheet width 297 mm of the A3 size, it is necessary to meet a relation of:

$$PW1 \geqq 1.414 \times PW2$$

When PW2 is set to the sheet size of 8.5" of the Letter size, in order to allow PW1 to record up to the sheet width 11" of the Ledger size, it is necessary to meet a relation of:

$$PW1 \geqq 1.294 \times PW2$$

Assuming the maximum widths of the form sizes PW1 and PW2, respectively, PW2 is the sheet width 8.5" (215.9 mm) of the Letter size, and PW1 is the sheet size 297 mm of the A4 size. In this case, it is necessary to meet the relation of PW1≧1.375×PW2. Accordingly, by taking general application into account, it is necessary to meet at least a relation of PW1≧1.190×PW2, and for a most general purpose recording apparatus, it is necessary to meet a relation of:

$$PW1 \geqq 1.375 \times PW2$$

Apparatus Embodiment 2

Figure 11:
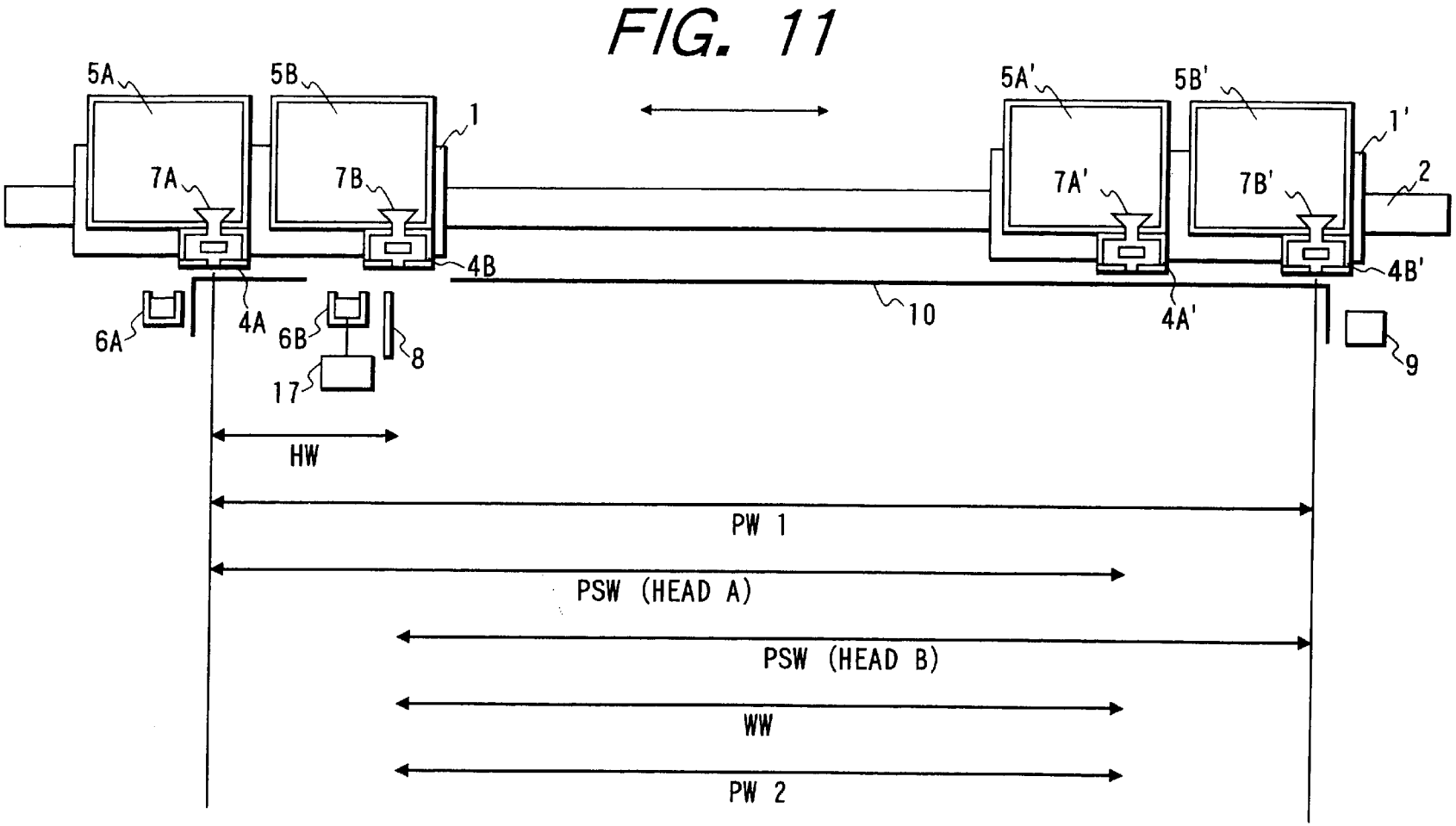
FIG. 11 schematically shows the recording apparatus in accordance with a configuration 2 of the present invention.

FIG. 11 shows a schematic diagram of an apparatus capable of recording on sheets of at least two sizes, like that of FIG. 10.

The carriage 1, the recording heads 4A and 4B, the ink tanks 5A and 5B and the ink supply ports 7A and 7B are shown at their positions in the left end recording, and the carriage 1', the recording heads 4A' and 4B', the ink tanks 5A' and 5B' and the ink supply ports 7A' and 7B' are shown at their positions in the right end recording.

The first recording width PW1 shows a maximum recordable width and PW2 shows a second recording width. In the present embodiment, the width PW2 is recorded by using the two recording heads 4A and 4B.

As shown in FIG. 11, when the recording of the widths of PW1 and PW2 is to be attained by using the two recording heads 4A and 4B, it is necessary that the head interval HW meets a relation of:

$$HW \leqq (PW1-PW2)/2$$

By constructing the apparatus such that the head interval HW meet the above condition, when the area of PW1 is recorded, the area of PSW having the end thereof at the left end of the recording area is recorded by using the recording head 4A, and the area of PSW having the end thereof at the right end is recorded by using the recording head 4B. The overlapping recording apparatus WW is recorded by the sharing of the recording heads 4A and 4B. Since PW2 has the width equal to the overlapping recording area WW, the recording may be made by the cooperation of the recording heads 4A and 4B.

It is preferable that the recordable sheet widths PW1 and PW2 are determined based on easily available form sizes.

Like in the previous embodiment, it is preferable to set PW" to the A4 size or the Letter size. By setting to those sizes, it may conform to all sheets having smaller sizes.

A relationship of the ratio of PW1 and PW2 changes depending on a particular form sheet selected as the maximum recordable width.

In the present embodiment, by taking this into consideration, the recordable width is determined based on the sheet width of the form sheet as it is in the Embodiment 1.

In the construction shown in FIG. 11, images of different densities may be recorded by the recording heads 4A and 4B by using heads having different ink discharge characteristics or ink discharged thereby having different ink dye densities, and a record of higher image quality may be recorded.

Figure 12:
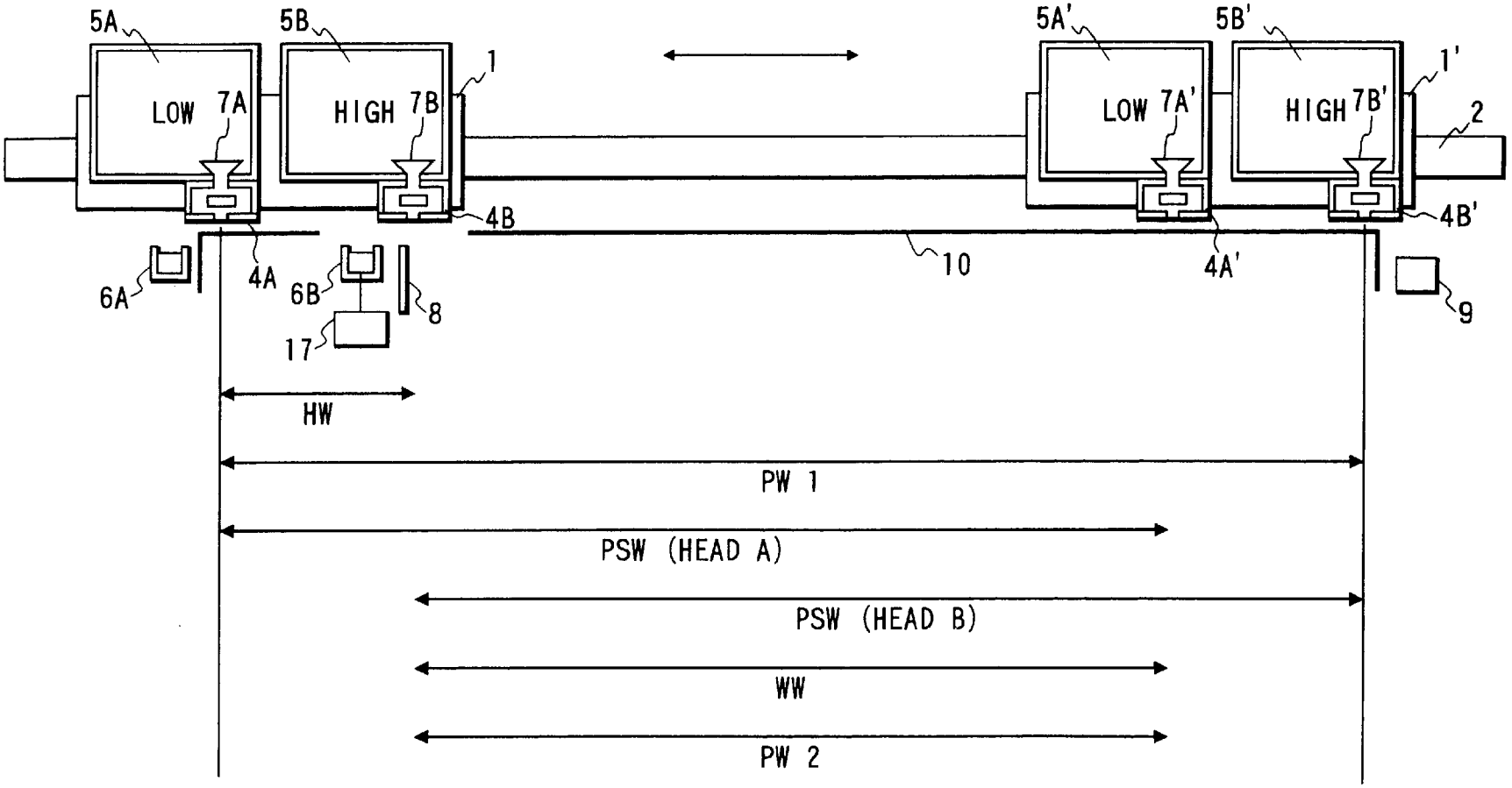
FIG. 12 schematically shows a case in which two recording heads of different recording characteristics are used in the recording apparatus in accordance with the configuration 2 of the present invention.

FIG. 12 shows a construction thereof. The ink tank 5A contains ink having a lower ink dye density than that of ink in the ink tank 5B, and an image is recorded at a low density by the recording head 4B. Thus, by recording the image in combination with the high density image by the recording head 4B, the granulation of the record dots observed in a light image area is relieved and the record of a high image quality by the smooth gray level reproduction is attained.

In the present embodiment, the ink tanks 5A and 5B are exchangeable as required. The recording heads 4A and 4B may be integral with the ink tanks and may be replaceable as a recording head unit having different recording characteristic or recording color.

Apparatus Embodiment 3

In the above Embodiments 1 and 2, the two recording heads 4A and 4B are mounted on the opposite sides of the carriage. In the present embodiment, three recording heads 4A, 4B and 4C are mounted on the carriage.

Figure 13:
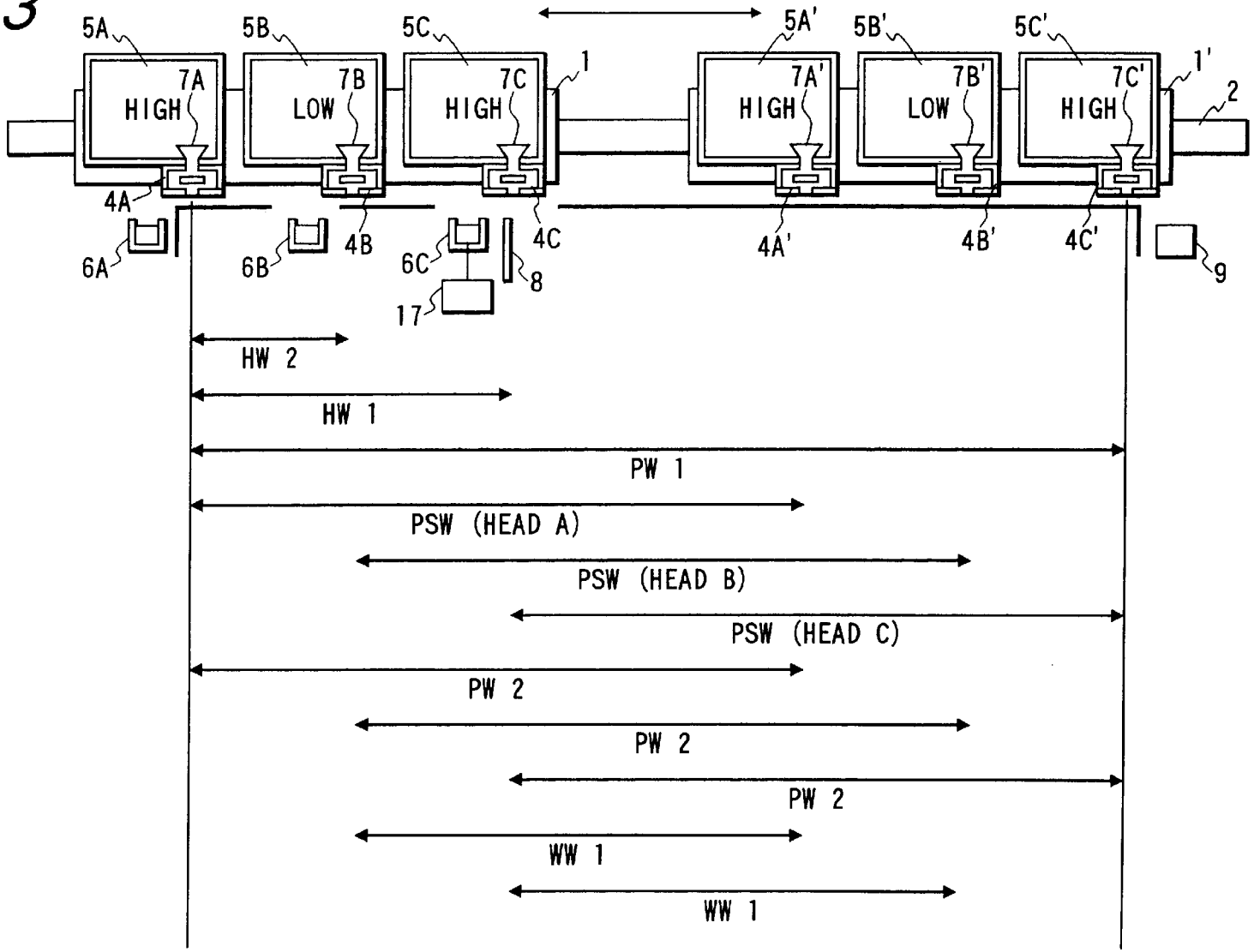
FIG. 13 schematically shows the recording apparatus in accordance with a configuration 3 of the present invention.
Figure 14:
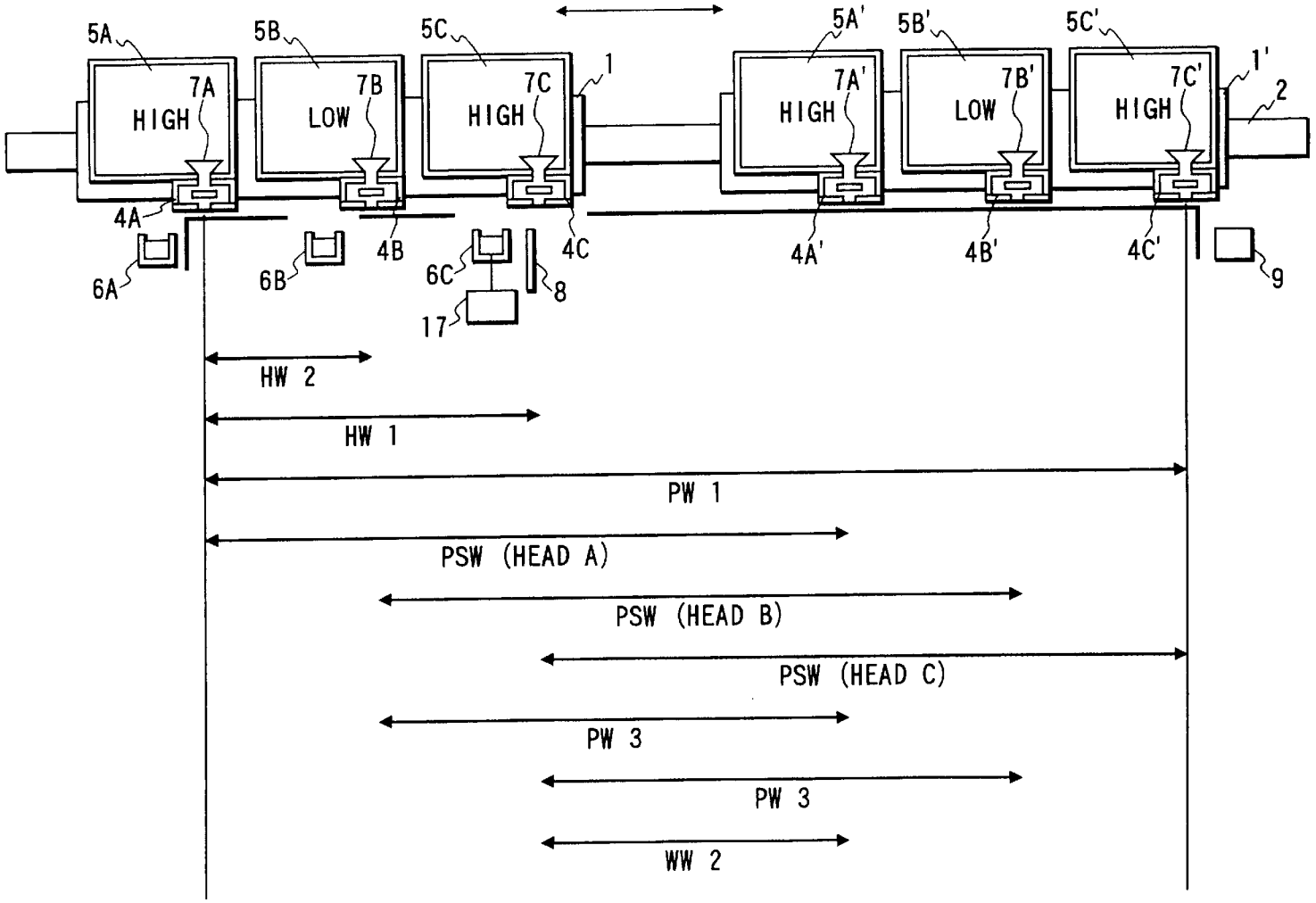
FIG. 14 schematically shows other recording apparatus in accordance with the configuration 3 of the present invention.

FIGS. 13 and 14 show schematic constructions of an apparatus capable of recording on sheets of at least three sizes.

The carriage 1, the recording heads 4A, 4B and 4C, the ink tanks 5A, 5B and 5C and the ink supply ports 7A, 7B and 7C are shown at their positions in the left end recording, and the carriage 1', the recording heads 4A', 4B' and 4C', the ink tanks 5A', 5B' and 5C' and the ink supply ports 7A', 7B' and 7C' are shown at their positions in the right end recording.

The first recording apparatus PW1 indicates a maximum recordable width, PW2 indicates a second recording width and PW3 indicates a third recording width.

In the present embodiment, a recovery unit (caps 6A, 6B and 6C) is provided below a platen at the left side and the center of the area through which the carriage 1 may be moved so that the discharge ports of the recording heads can be capped during the non-print mode. Numerals 7A, 7B and 7C denote ink supply ports through which inks are introduced into the recording heads 4A, 4B and 4C from the ink tanks 5A, 5B and 5C, respectively.

When the width of the maximum recordable width PW1 is to be recorded, the positions of the preliminary discharge are only the cap 6A and the preliminary discharge receptacle 9. In the present embodiment, the two recording heads 4A and 4C are used to allow the recording of the width of PW1, any one of the recording heads 4A, 4B and 4C is used to allow the recording of the width of PW2, all of the recording heads 4A, 4B and 4C are used to allow the recording of the width of PW2, and the two recording heads 4A and 4B or 4B and 4C are used to allow the recording of the width of PW3. In the present embodiment, like in the previous Embodiment 2, the recording of an image of high image quality may be attained by using different recording heads or different ink densities.

In FIGS. 13 and 14, the ink tank 5B contains ink having a lower ink dye density than those of the ink tanks 5A and 5B. Thus, the recording head 4B records an image at a low density. By recording the image in combination with the high density images by the recording heads 4A and 4C, the granulation of the record dots observed in a light image area is relieved and the recording of the image of high image quality by the smooth gray level reproduction is attained.

The recording heads 4A, 4B and 4C may be integral with the ink tanks and they may be replaceable as a recording head unit having different recording characteristic or recording colors.

In the present embodiment, the cap 6A and the preliminary discharge receptacle 9 are provided on the opposite sides of the apparatus which are not traversed by the recording medium, at the position of the preliminary discharge conducted during the recording operation.

In order to conduct the preliminary discharge of the recording head 4B, it must be moved to the preliminary discharge position at one of the opposite ends of the apparatus so that the carriage must be substantially moved during the recording operation.

At the position of the recording head 4B, it is set such that the ink having the dye density which is lower than that of the normal ink is discharged. By using the ink of the low density, a risk of failure of the discharge of the non-used discharge port due to the evaporation of the ink and the affect to the change of tonality are reduced. Accordingly, in the present embodiment, the preliminary discharge operation for the recording head 4B during the image recording is not necessary.

Thus, the scan movement distance of the carriage necessary for the preliminary discharge operation is same as those in the previous Embodiments 1 and 2.

As seen from FIGS. 13 and 14, when the recording of the width of PW2 is to be attained by using any one of the recording heads 4A, 4B and 4C loaded with standard inks, it is necessary that the head interval HW1 meets a relation of:

$$HW1 \leqq PW1-PW2$$

By the construction of the above head interval HW1, the recording width of PW2 (=PSW) from the left end of the recording area can be recorded by using the recording head 4A and the recording width of PW2 (=PSW) from the right end can be recorded by using the recording head 4C. The area width of PW1 can be recorded by the sharing of the corresponding areas of PW2 by the recording heads 4A and 4C. In this case, the overlapping recording area WW2 can be recorded by appropriate sharing by the recording heads 4A and 4C.

It is preferable to determine the recordable sheet widths PW1 and PW2 based on easily available form sizes and the examples thereof are identical to those of the Embodiments 1 and 2.

In the present embodiment, the width of PW2 at the center of the apparatus is recorded by the cooperation of the three recording heads, the recording heads 4A and 4B having the standard inks mounted and the recording head 4B having the low density ink mounted. The width of the area of the left side PW3 is recorded by using the recording head 4A and the width of the area of the right side PW3 is recorded by the recording head 4C. The image of the low density ink can be recorded by using the recording head 4C.

The head interval HW2 in the present embodiment is equal to the head interval of the recording heads 4A and 4B or the recording heads 4B and 4C. At least one of the head intervals HW2 of the recording heads 4A and 4B or the recording heads 4B and 4C is set to the position of $HW2 \leqq HW1/2$. The area width which can be recorded by using any two of the recording heads, the recording heads 4A and 4B or the recording heads 4B and 4C is PW3, and when $HW2=HW1/2$, a relation of $PW3=PW1-3\times HW2=PW1-1.5\times HW1$ is met. Further, the area width PW3 meets a relation of $PW3=PW1-HW1-HW2$.

For the area width PW3, it is preferable to secure at least the widths of the B5 size (sheet width: 182 mm), the A5 size and a post card size (sheet lateral size: 148 mm) which are the sheet widths of the form sizes.

Figure 15:
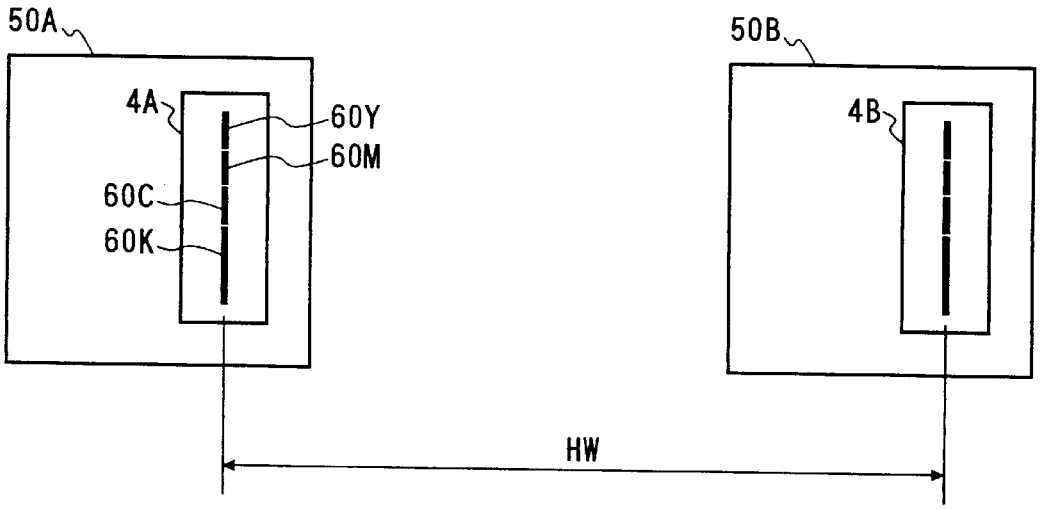
FIG. 15 illustrates a head spacing in a recording head having all color discharging ports are integrally formed.

In the above embodiments, the recording head has the discharge ports of Bk, C, M and Y integrally formed as shown in FIG. 15. Numeral 60K denotes the Bk discharge port, numeral 60C denotes the C discharge port, numeral 60M denotes the M discharge port and numeral 60Y denotes the Y discharge port. In FIG. 15, the head interval is represented by HW.

Figure 16:
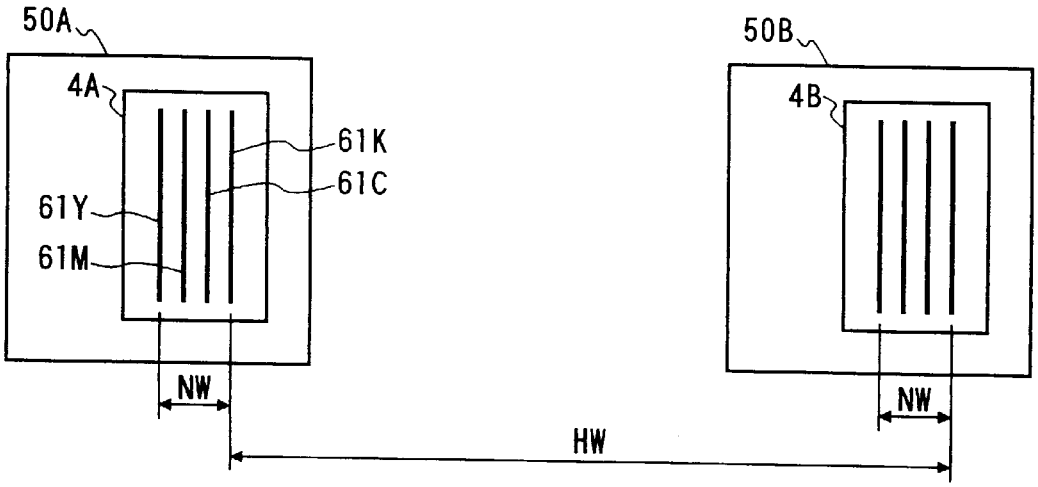
FIG. 16 illustrates a head spacing in a recording head having all color discharging ports are parallelly formed.

The recording apparatus may have the Bk, C, M and Y discharge ports parallelly formed as shown in FIG. 16. Numeral 61K denotes the Bk discharge port, numeral 61C denotes the C discharge port, numeral 61M denotes the M discharge port and numeral 61Y denotes the Y discharge port. In FIG. 16, the head interval is represented by HW. When the recording apparatus shown in FIG. 16 is used, extra carriage scan corresponding to NW is needed in addition to that by the recording head shown in FIG. 15 when a predetermined area is to be recorded.

In the present embodiment, the integrated ink tank of the respective colors is used. Alternatively, ink tanks which are replaceable for each color may be used.

As a form of the ink tank, different ink tank for each recording head is provided in the present embodiment. Alternatively, the ink tank for supplying inks in common to the respective recording heads may be used by utilizing the space of the carriage.

Further, as the carriage scan drive method, the drive belt is used in the present embodiment. Alternatively, a rail member may be provided on the carriage depending on the size of the carriage and it may be directly linked to the carriage motor to conduct the drive scan.

Further, a line of magnetic poles my be provided on the carriage to conduct the linear motor drive or an ultrasonic wave drive source may be press-contacted to a linear rail mirror-finished at a precision conformable to the ultrasonic wave vibration to conduct the ultrasonic wave motor drive.

Further, in the present embodiment, the ink jet recording system has been explained as the representative example to record the coloring materials mounted on the carriage by transferring them to the recording medium although the present invention is applicable to recording apparatus of other systems for recording by transferring the coloring materials mounted on the carriage to the recording medium such as the thermal transfer system, the thermal sublimation system or the impact wire dot system.

In accordance with the invention, when the maximum size of the recording medium recordable by the recording apparatus is given, the arrangement interval of the recording heads is defined as described above so that the recording heads record by sharing the corresponding recording areas to allow the recording to the area of the first recording width which is the recording area of the maximum size, and the recording to the area of the second recording width of the smaller size is attained by the recording by either singly or in combination of the plurality of recording heads.

Since the arrangement interval of the recording heads is defined in this manner, the apparatus size may be substantially equal to the maximum first recording width (in actual, the length of the carriage is to be added) and the scan distance of the carriage is made substantially equal to the width of the divided recording area which is smaller than the first recording width (in actual, the length of lamp up/down is to be added). Accordingly, the record images of various sizes can be attained without increasing the size of the apparatus.

Also, when the recording area of the second recording width is given as the overlapping recording area, the area is recorded by the cooperation of a plurality of recording heads and a high grade record image with a small size may be obtained.

What is claimed is:

1. A recording apparatus for recording on a recording medium by using a plurality of recording heads, the recording apparatus recording over a recording area divided into plural divided recording areas in correspondence to the plurality of recording heads, said recording apparatus comprising:

scan means having a carriage capable of mounting said recording heads at a predetermined interval for causing said recording heads to scan corresponding ones of the divided recording areas; and recording control means for causing said recording heads to conduct a first record mode to record a first area of a first recording width in a direction of scan by shared recording by said recording heads of the corresponding divided recording areas, and to conduct a second record mode to record a second area of a second recording width smaller than the first recording width by causing at least one of said recording heads to record in the corresponding divided recording area when the corresponding divided recording areas are scanned, wherein a distance between two recording heads mounted at positions outermost in the arrangement of recording heads on said carriage is not larger than a difference between the first recording width and the second recording width.

2. A recording apparatus according to claim 1, wherein the distance between said two recording heads is equal to the difference between the first recording width and the second recording width.

3. A recording apparatus according to claim 1, wherein said second record mode records by only one of said recording heads.

4. A recording apparatus according to claim 1, wherein said second record mode records an overlapping area of the divided recording areas by at least two of said recording heads.

5. A recording apparatus according to claim 4, wherein the distance between said two recording heads is not larger than ½ of the difference between the first recording width and the second recording width.

6. A recording apparatus according to claim 5, wherein the distance between said two recording heads is equal to ½ of the difference between the first recording width and the second recording width.

7. A recording apparatus according to claim 5, wherein said second record mode records by two of said recording heads.

8. A recording apparatus according to claim 5, wherein said second record mode records by three of said recording heads.

9. A recording apparatus according to claim 4, wherein one of said at least two recording heads for recording in the overlapping recording area records in a recording density different from recording densities of others of said at least two recording heads.

10. A recording apparatus according to claim 4, wherein said at least two recording heads comprise ink jet recording heads, respectively, and one of said at least two recording heads discharges an ink discharge amount or ink density different from ink discharge amounts or ink densities of others of said at least two recording heads.

11. A recording apparatus according to claim 10, wherein each of said recording heads generate air bubbles in ink by utilizing thermal energy, and discharge the ink by pressure of the air bubbles.

12. A recording apparatus according to claim 10, wherein said recording heads discharge inks of a plurality of colors to said recording medium.

13. A recording apparatus according to claim 1, wherein said recording heads comprise two recording heads.

14. A recording apparatus according to claim 1, wherein said recording heads comprise three recording heads.

15. A recording apparatus according to claim 1, wherein said first recording width is not smaller than 1.190 times of said second recording width.

16. A recording apparatus according to claim 1, wherein said first recording width is not smaller than 1.375 times of said second recording width.

17. A recording apparatus according to claim 1, wherein said recording heads record on said recording medium in a plurality of colors.

18. A recording apparatus according to claim 1, wherein said divided recording areas overlap.

19. A recording apparatus for recording on a recording medium, the recording apparatus recording over a recording area divided into plural divided recording areas, said recording apparatus comprising:

scan means having a carriage capable of mounting a plurality of first recording heads arranged at a predetermined interval and at least one second recording head arranged between said first recording heads, said carriage for causing said first recording heads to scan corresponding divided recording areas, said second recording head having a characteristic different from characteristics of said first recording head, said divided recording areas together comprising an entire recording area of said recording apparatus divided in a direction of scan; and record control means for causing said first recording heads to conduct a first record mode to record first areas of a first recording width in the direction of scan by shared recording by said first recording heads of the corresponding divided recording areas, to conduct a second mode to record a second area of a second recording width smaller than the first recording width by a single one of said first recording heads or by cooperation of at least two of said recording heads and said second recording head, and to conduct a third record mode to record a third area of a third recording width smaller than the second recording width by cooperation of one of said first recording heads and said second recording head when said corresponding divided recording areas are scanned;

wherein a first distance between two first recording heads mounted at positions outermost in the arrangement of first recording heads on said carriage is not larger than a difference between the first recording width and the second recording width, and a second distance between said two first recording heads and said second recording head is not larger than one half of the difference between the first recording width and the second recording width.

20. A recording apparatus according to claim 19, wherein said third recording width is not larger than said first recording width less said first distance and said second distance.

21. A recording apparatus according to claim 19, wherein said second recording head records at a density lower than densities of said first recording heads.

22. A recording apparatus according to claim 19, wherein said first and second recording heads record by discharging inks and said second recording head discharges an amount of ink less than amounts of said first recording heads.

23. A recording apparatus according to claim 19, wherein said first recording width is not smaller than 1.190 times of said second recording width.

24. A recording apparatus according to claim 19, wherein said first recording width is not smaller than 1.375 times of said second recording width.

25. A recording apparatus according to claim 19, wherein said divided recording areas overlap.

* * * * *

UNITED STATES PATENT AND TRADEMARK OFFICE

CERTIFICATE OF CORRECTION

PATENT NO. : 6,000,781

DATED : December 14, 1999

INVENTOR(S) : YUJI AKIYAMA, et al.

It is certified that error appears in the above-identified patent and that said Letters Patent is hereby corrected as shown below:

ON THE COVER PAGE

Under "References Cited, U.S. Patent Documents", insert the following:

--4,131,898 12/1978 Gamblin .....346/75--; and

Under "References Cited, Foreign Patent Documents", insert the following:

| | | |
|---|---|---|
| --724,965 | 8/1996 | Europe |
| 58-22176 | 2/1983 | Japan |
| 60-145867 | 8/1985 | Japan |
| 61-3760 | 1/1986 | Japan |
| 61-274966 | 12/1986 | Japan |
| 1-221251 | 9/1989 | Japan |
| 5-50614 | 3/1993 | Japan--. |

COLUMN 2

Line 5, delete "for"

COLUMN 3

Line 21, change "lease" to --least--.

UNITED STATES PATENT AND TRADEMARK OFFICE

CERTIFICATE OF CORRECTION

PATENT NO. : 6,000,781

DATED : December 14, 1999

INVENTOR(S) : YUJI AKIYAMA, et al.

It is certified that error appears in the above-identified patent and that said Letters Patent is hereby corrected as shown below:

COLUMN 6

Line 29, change "linearly" to --linearity--.

COLUMN 9

Line 14, change "male" to --make--.

COLUMN 10

Line 17, delete "from".

Signed and Sealed this

Thirtieth Day of January, 2001

*Attest:*

Q. TODD DICKINSON

*Attesting Officer*

*Director of Patents and Trademarks*